US005583617A

United States Patent [19]

Altrieth, III et al.

[11] Patent Number: 5,583,617

[45] Date of Patent: Dec. 10, 1996

[54] JAM CLEARANCE OPERATOR CONTROL FOR A REPRODUCTION APPARATUS

[75] Inventors: Frederick E. Altrieth, III, Scottsville; Barbara S. Smith, Fairport; Nelson C. Kunkel, Rochester, all of N.Y.

[73] Assignee: Eastman Kodak Company, Rochester, N.Y.

[21] Appl. No.: 400,153

[22] Filed: Mar. 7, 1995

[51] Int. Cl.[6] ..... G03G 21/00

[52] U.S. Cl. ..... 355/209; 345/117

[58] Field of Search ..... 355/209, 207, 355/206, 205, 200; 395/183.22, 185.1; 345/117, 122

[56] References Cited

U.S. PATENT DOCUMENTS

| | | | |
|---|---|---|---|
| 4,583,834 | 4/1986 | Seko et al. | 355/206 X |
| 4,609,919 | 9/1986 | Miyazaki et al. | 345/117 |
| 4,740,818 | 4/1988 | Tsilibes et al. . | |
| 4,996,557 | 2/1991 | Takagi | 355/206 X |
| 5,010,551 | 4/1991 | Goldsmith et al. . | |
| 5,045,880 | 9/1991 | Evanitsky et al. | 355/200 |
| 5,049,931 | 9/1991 | Knodt | 355/209 |
| 5,061,958 | 10/1991 | Bunker et al. | 355/209 |
| 5,105,220 | 4/1992 | Knodt et al. | 355/209 |
| 5,113,222 | 5/1992 | Wilson et al. | 355/209 |
| 5,127,012 | 6/1992 | Hiliger | 355/206 X |
| 5,165,012 | 11/1992 | Crandall et al. | 395/100 |
| 5,408,650 | 4/1995 | Arsenault | 395/183.13 |
| 5,463,448 | 10/1995 | Wilson et al. | 355/209 X |
| 5,467,449 | 11/1995 | Gauronski et al. | 395/185.1 |

*Primary Examiner*—Matthew S. Smith
*Attorney, Agent, or Firm*—William F. Noval

[57] ABSTRACT

In reproduction apparatus having a plurality of selectable features for carrying out a reproduction run, an operator control panel for providing operator interface for controlling the reproduction apparatus. The operator control panel includes a display for displaying a sequence of graphics at periodic intervals to assist an operator in carrying out a task involving the reproduction apparatus and a touchscreen overlaying the display having an operator actuable touch button for providing operator input to the reproduction apparatus for causing a current graphic displayed to be held, thereby disabling the periodic sequencing of the graphics.

6 Claims, 13 Drawing Sheets

JAM CLEARANCE OPERATOR CONTROL FOR A REPRODUCTION APPARATUS

FIELD OF THE INVENTION

The present invention relates, in general, to reproduction apparatus, and relates, more specifically, to a jam clearance operator control for an electrographic reproduction apparatus.

BACKGROUND OF THE INVENTION

Electrographic reproduction apparatus are provided with an operator control panel for allowing an operator to program the apparatus for a reproduction run. In its simplest form, the control panel includes several dedicated (hard) buttons and switches for selecting features for a reproduction run, as well as visual indicators for informing the operator which features were selected. The operator control panel can also have a display for displaying text and graphics. The control panel also includes keys and buttons for altering the display to indicate selected options. (See, for example, U.S. Pat. No. 5,113,222, issued May 12, 1992, to Wilson et al.) The display may also include a touchscreen overlay having "soft buttons" for providing operator input to the reproduction apparatus. (See, for example, U.S. Pat. No. 5,045,880, issued Sep. 3, 1991 to Evanitsky et al; U.S. Pat. No. 5,061,958, issued Oct. 29, 1991 to Bunker et al.; U.S. Pat. No. 5,105,220, issued Apr. 14, 1992 to Knodt et al.; U.S. Pat. No. 5,049,931, issued Sep. 17, 1991 to Knodt; and U.S. Pat. No. 5,010,551, issued Apr. 23, 1991 to Goldsmith et al.)

When a malfunction occurs in the reproduction apparatus, such as a document or copy paper jam, frequently it can be cured through operator action. For example, if a copy paper jam occurs, the paper path is usually accessible to the operator so that the jammed paper can be removed. Typically, the operator is alerted to the malfunction by a visual warning such as a displayed error message, blinking indicator or the like. Additionally, graphics can be displayed to identify the location of the paper jam and to assist an operator in clearing the jam. Where graphics are displayed, they should be under control of the operator so that the malfunction (jam clearance) can be cured taking into account the level of the operator's learning skill and the ease of manually clearing the jam. Where graphics are automatically sequenced at a periodic rate, it would be desirable for the operator to stop the sequence if difficulty is encountered by the operator in accomplishing the task. For example, in clearing a paper jam, several mechanical assemblies may have to be handled before the paper jam is found. Handling of each assembly may take more time than is allotted for display of a related graphic to the operator.

SUMMARY OF THE INVENTION

According to the present invention, there is provided a solution to the problems of the prior art by providing operator control of the display of graphics useful in assisting the operator in carrying out a task, such as sheet jams, involving a reproduction apparatus.

According to a feature of the present invention, there is provided in a reproduction apparatus having a plurality of selectable features for carrying out a reproduction run, an operator control panel for providing operator interface for controlling said reproduction apparatus comprising:

a display for displaying a sequence of graphics at periodic intervals to assist an operator in carrying out a task involving the reproduction apparatus; and a touchscreen overlaying said display having an operator actuable "hold" touch button for providing operator input to said reproduction apparatus to cause a current graphic displayed to be held, thereby disabling the periodic sequencing of said graphics, when the button is turned on, and to cause resumption of said periodic sequencing of said graphics when said button is turned off.

DETAILED DESCRIPTION OF THE PREFERRED EMBODIMENTS

Because electrographic reproduction apparatus 1 are well-known, the present description will be directed, in particular, to elements forming part of or cooperating more directly with the present invention. Apparatus not specifically shown or described herein are selectable from those known in the prior art. Particular reference is made to U.S. Pat. No. 4,740,818 and U.S. Pat. No. 5,113,222, the contents of which are incorporated herein by reference.

Figure 1:
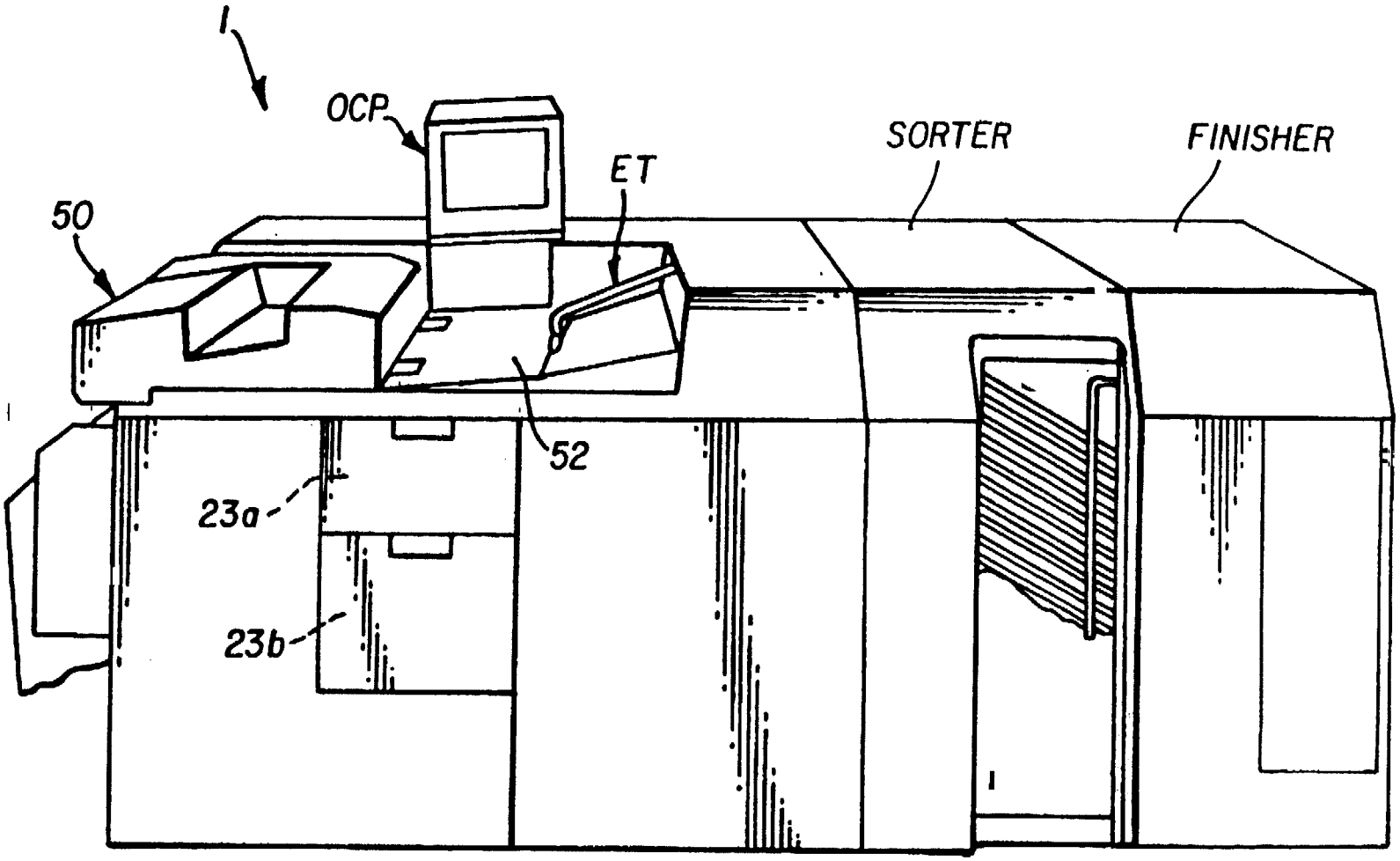
FIG. 1 is a front perspective view of an electrographic reproduction apparatus for incorporating the present invention.

With reference now to FIG. 1, there is shown an electrographic reproduction apparatus 1 having a recirculating document feeder 50 that includes a tray portion for accepting a multi-sheet document original for reproduction. The apparatus 1 includes an operator control panel (OCP) which, as will be described, includes buttons and prompting displays for facilitating a job setup, i.e., the input of an instruction set to the apparatus logic and control unit (LCU) to enable it to control a series of operations resulting in a desired copy output representing a reproduction of the document originals. Copies may be produced on receiver sheets stored in either or both drawers holding trays 23*a* and 23*b*. The copy output from the apparatus is stored either in an exit tray (ET) or finisher/sorter (F/S) having a series of sorter bins, as is well known.

Figure 2:
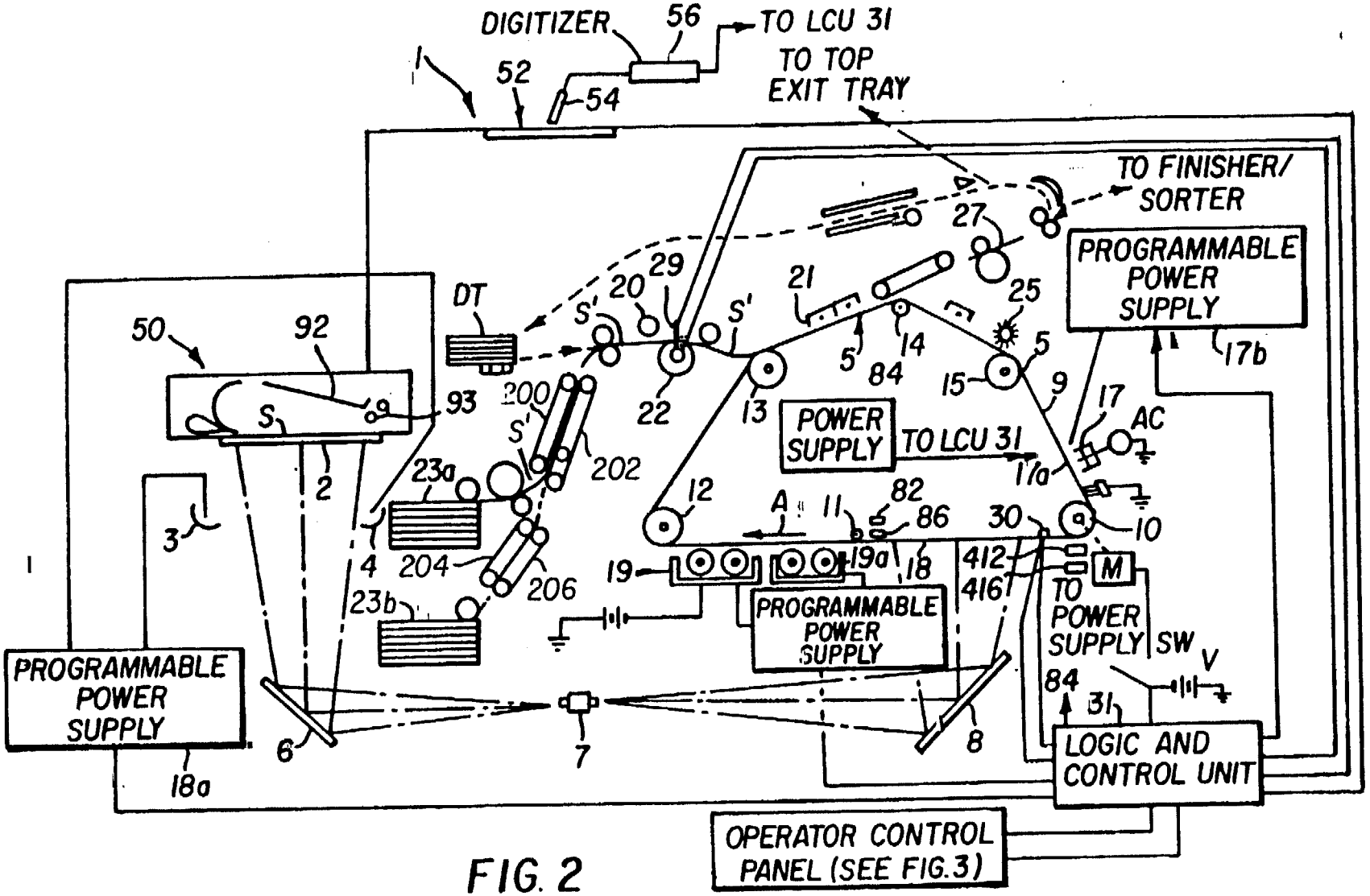
FIG. 2 is a schematic diagram of the electrographic reproduction apparatus of FIG. 1.

Referring now to FIG. 2, the electrographic reproduction apparatus of FIG. 1 incorporating the present invention will be described in greater detail. As shown, reproduction apparatus 1 includes a photoconductive web 5 that is trained about six transport rollers 10, 11, 12, 13, 14 and 15, thereby forming an endless or continuous web. Roller 10 is coupled to a drive motor M in a conventional manner. Motor M is connected to a source of potential V when a switch SW is closed by a logic and control unit (LCU) 31. When the switch SW is closed, the roller 10 is driven by the motor M and moves the web 5 in clockwise direction as indicated by arrow A. This movement causes successive image areas of web 5 to sequentially pass a series of work stations of the apparatus 1. These workstations include: a charging station 17,17*a* at which the photoconductive surface 9 of the web 5 is sensitized by applying to such surface a uniform electrostatic charge of a predetermined voltage; an exposure station 18 at which a light image of a document sheet S, supported on transparent platen 2, is projected by mirrors 6, 8 and lens 7 onto the photoconductive surface 9 of the web 5 to produce a latent electrostatic image of the document sheet. Also included are a magnetic brush development station 19 at which the latent image is developed with developer which may consist of iron carrier particles and electroscopic toner particles with an electrostatic charge opposite to that of the latent electrostatic image, to form a toner image on web 5. A transfer station, including a corona charger 21 transfers the toner image on web 5 to a copy sheet S' which is transported to a heated pressure roller fuser 27 where the toner image is fixed to copy sheet S'. The sheet S' containing a fixed toner image is fed to a finisher/sorter or a top exit tray.

A cleaning station 25 is provided to clean the photoconductive surface 9 of web 5 of any residual toner particles remaining after the toner images have been transferred.

Copy sheet S' is fed from one of supplies 23*a* or 23*b*, by means of belts 200,202 and/or belts 204,206, to continuously driven rollers 20 which urge sheet S' against a rotating registration finger 29 of a copy sheet registration mechanism 22, from which it is fed to the transfer station 21. After transfer of an image to sheet S', it is removed from belt 5 by vacuum belt 208 and transported to fuser roller 27.

Apparatus 1 includes an additional color development station 19*a*, a duplex tray DT and a digitizer, including digitizer tablet 52, wand 54 and circuit 56 which provide digital signals to LCU 31.

Figure 3:
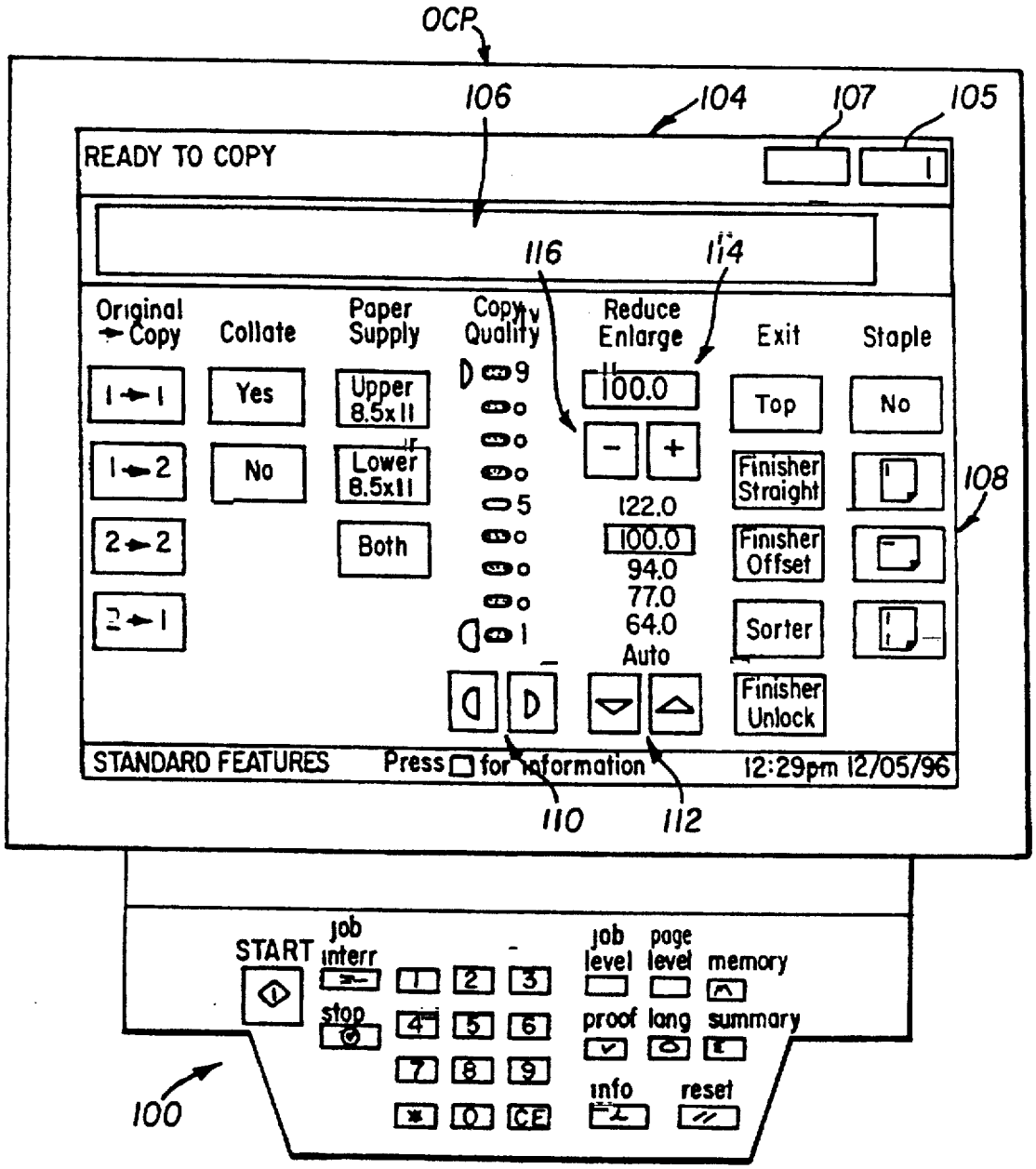
FIG. 3 is a diagrammatic view of an operator control panel, including a display with a touchscreen.

Referring now to FIG. 3, there is shown an operator control panel (OCP) which includes a set 100 of dedicated "hard" buttons or keys and a touchscreen display 104 to allow operator input and control of apparatus 1. The touchscreen display 104 includes (1) a known programmable type display wherein LCU 31 includes a computer program and a bit map memory for controlling the representation that is visible on the display and (2) a touchscreen which overlays the display. The touchscreen is an operator input device having operator actuable "soft" buttons and areas for providing operator input to the reproduction apparatus. Touchscreens are well known and include resistive, acoustic, and infrared type input technologies.

The operator selectable set of hard buttons on the left include, START, JOB INTERRUPT, and STOP buttons. In the middle are numerical buttons 0–9 to set the number of copies or sets to be copied. A * and CE (clear entry) buttons are also included. On the right are the following hard buttons; JOB LEVEL, PAGE LEVEL, MEMORY, PROOF, LANGUAGE, SUMMARY, INFORMATION and RESET. The INFORMATION (i) button accesses an information system (stored in memory in LCU 31) which provides detailed information about reproduction apparatus 1 including features selectable by the operator and messages which are displayed on touchscreen display 104.

As shown in FIG. 3, the screen illustrated on the touchscreen display is referred to as the "standard features" screen as it displays various features that a casual user of the apparatus 1 would want when first approaching the apparatus for an average reproduction run. The screen includes a message display area 106, a copies or sets requested display area 105, a copies or sets completed display area 107, and a "soft" button area 108. The "soft" button area includes selectable features with plural displayed options for each feature. The features shown are original copy, collate, paper supply, copy quality, reduce/enlarge, exit, staple. The plural selected options for each feature are provided with operat actuable soft buttons overlaying the displayed featu options. The selected feature option is highlighted.

The copy quality and reduce/enlarge features are provid with respective scroll buttons 110,112 for scrolling throu the feature options. The feature Options are sequential highlighted during scrolling. The reduce/enlarge feature al includes a zoom option 114 with scroll buttons 116.

Certain feature options may also be locked out to t operator, although displayed. Such feature option (e.g., t "finisher unlock" option under the "exit" feature shown FIG. 3) is highlighted in a different manner than highlight feature options.

According to the present invention, a jam of an origin document sheet or a copy sheet in reproduction apparatus causes an error message to be displayed on operator contr panel OCP. A sequence of graphics are displayed on the OC to show each step of the required clearance of the jam order to assist the operator clearing the jam. The graphics a sequenced at a fixed time interval. Once the jam has be cleared, the operator can restarts the operation of apparat 1.

Figure 4:
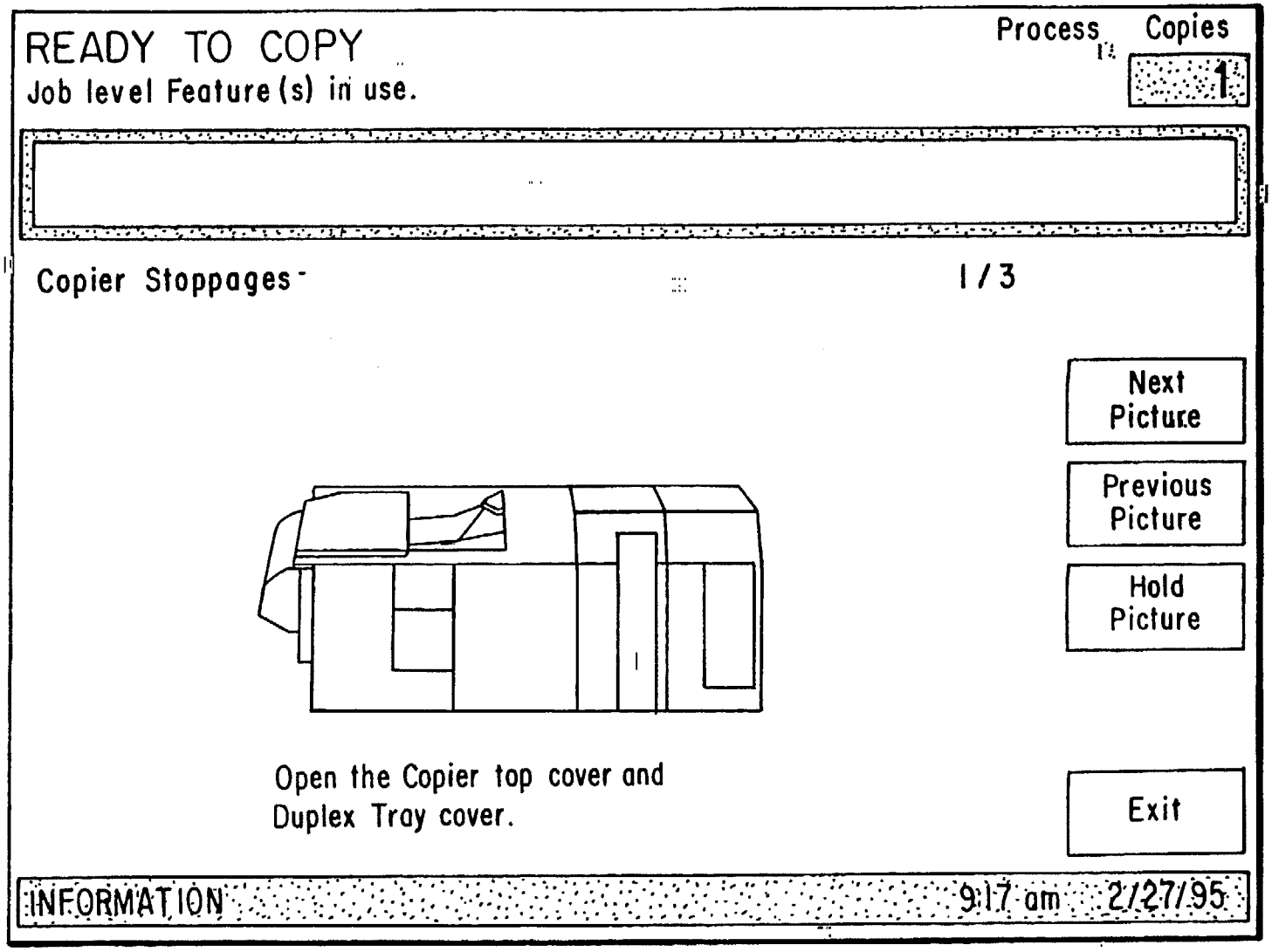
FIGS. 4–13 are respective screens useful in explaining the present invention.

As shown in FIG. 4, a "Copier Stoppage" screen displayed on the OCP. This screen includes a graphic of t copier (electrographic reproduction apparatus 1), messag suggesting operator action ("Open the Copier top cover a Duplex Tray cover."), and several operator selectable s buttons for controlling the sequencing of graphics. Turni the "Hold Picture" soft button on freezes the graphic bei displayed and disables the periodic sequencing of the grap ics. Turning the "Hold Picture" soft button off causes t next graphic in the sequence to be displayed and enables t periodic sequencing of the graphics. This "Hold" featu gives the operator more time to examine in detail a particul area of the paper path of the reproduction apparatus, th decreasing the difficulty of clearing a copy sheet jam.

The "Next Picture" and "Previous Picture" soft butto enable the operator to respectively display the next previous graphic. This permits an operator to go back forward and thus to cycle between graphics at the operator own pace. The "Exit" soft button returns the OCP screen the Standard Features screen.

Figure 5:
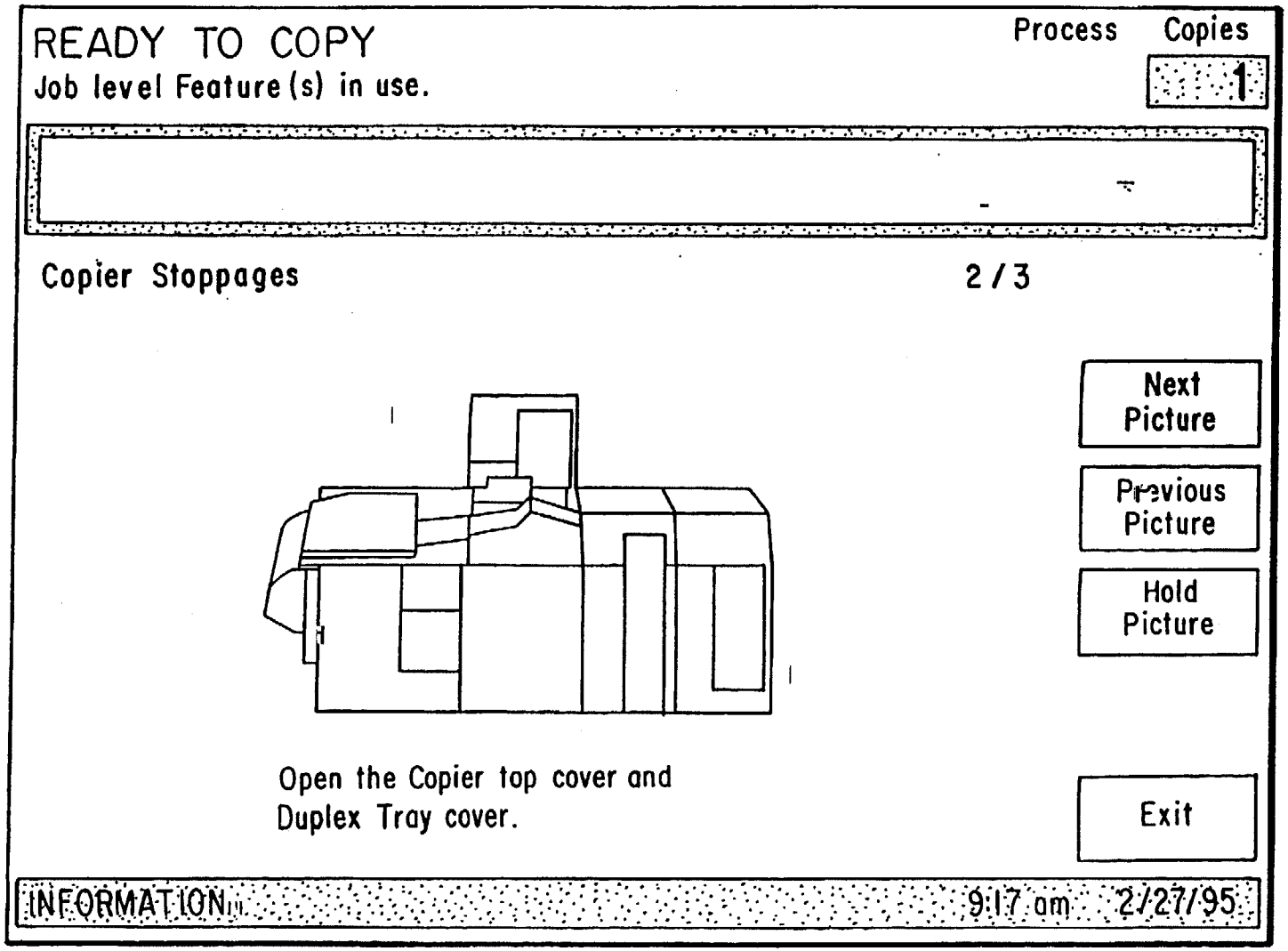
Figure 6:
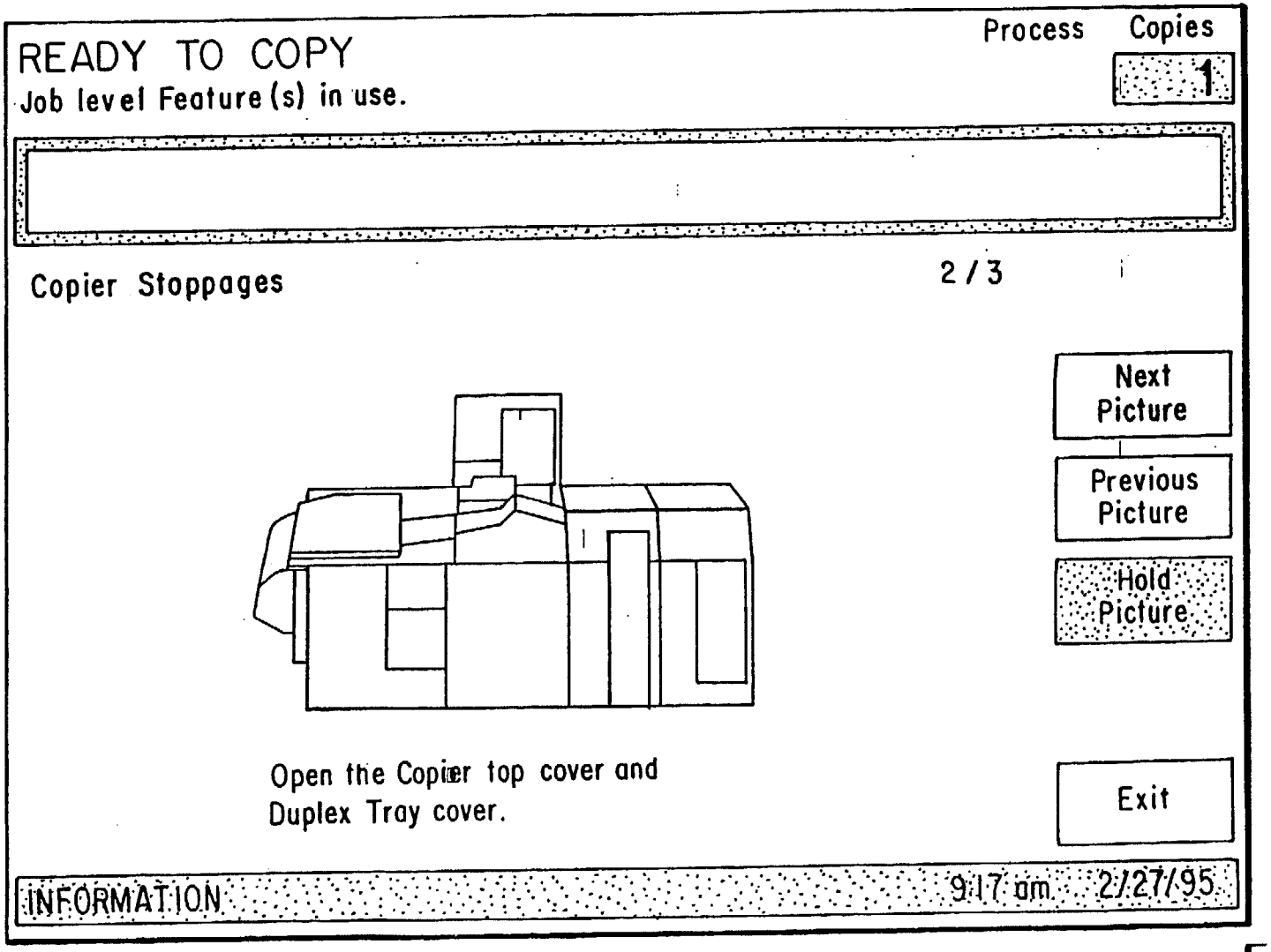
Figure 7:
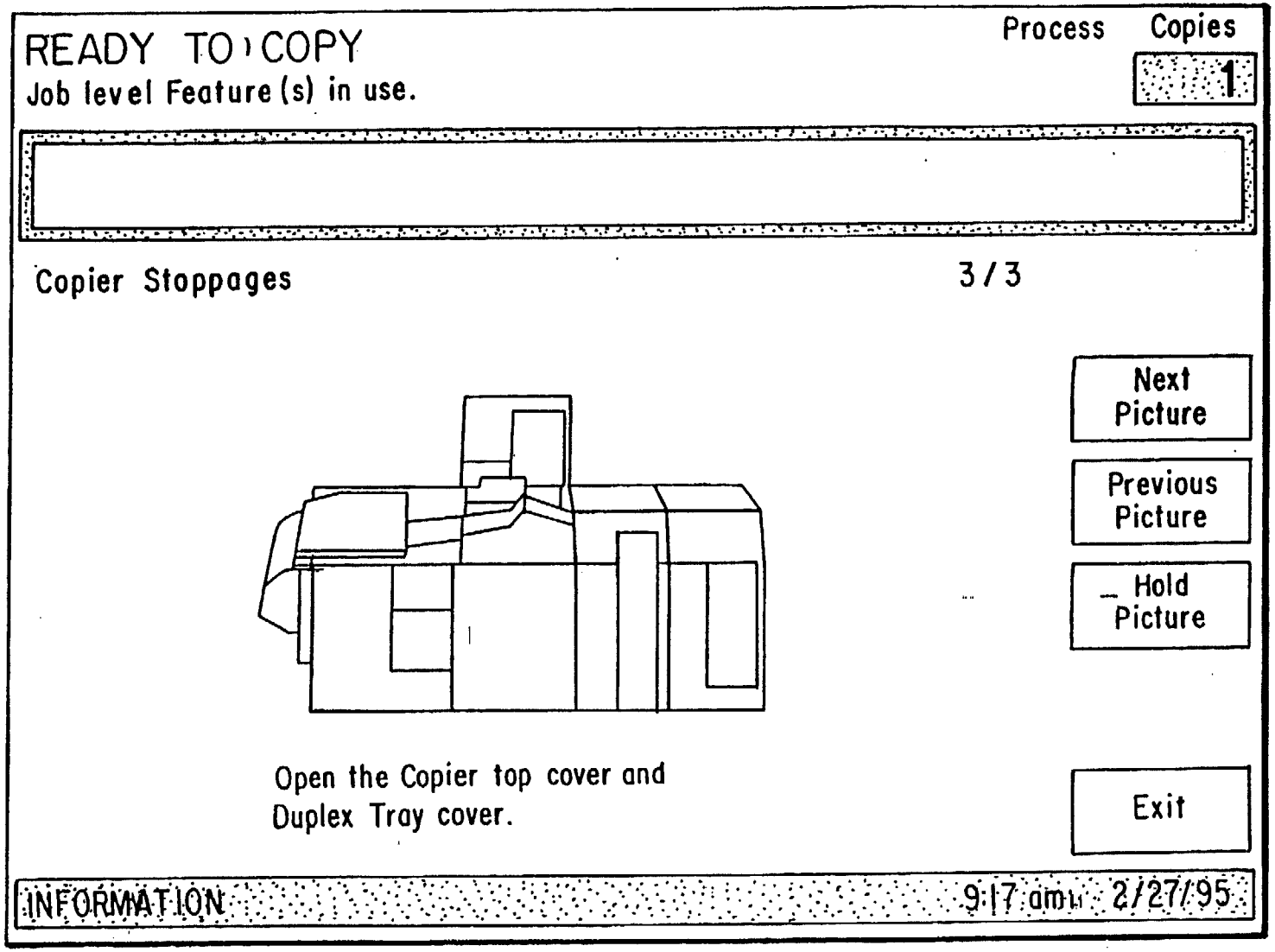

FIGS. 4–7 are useful in explaining the "Hold Pictur feature of the present invention. As shown in FIG. 4, graphic of the electrographic reproduction apparatus (copier) is shown. The operator is instructed to open t copier top cover and duplex tray cover. FIG. 5 shows graphic of the copier with the top cover and duplex tr cover opened. FIG. 6 shows the same copier graphic as FI 5 after the "Hold Picture" button has been selected by t operator. FIG. 7 shows that the operator has turned the "Ho Picture" button off so that periodic sequencing of the grap ics can resume.

Figure 8:
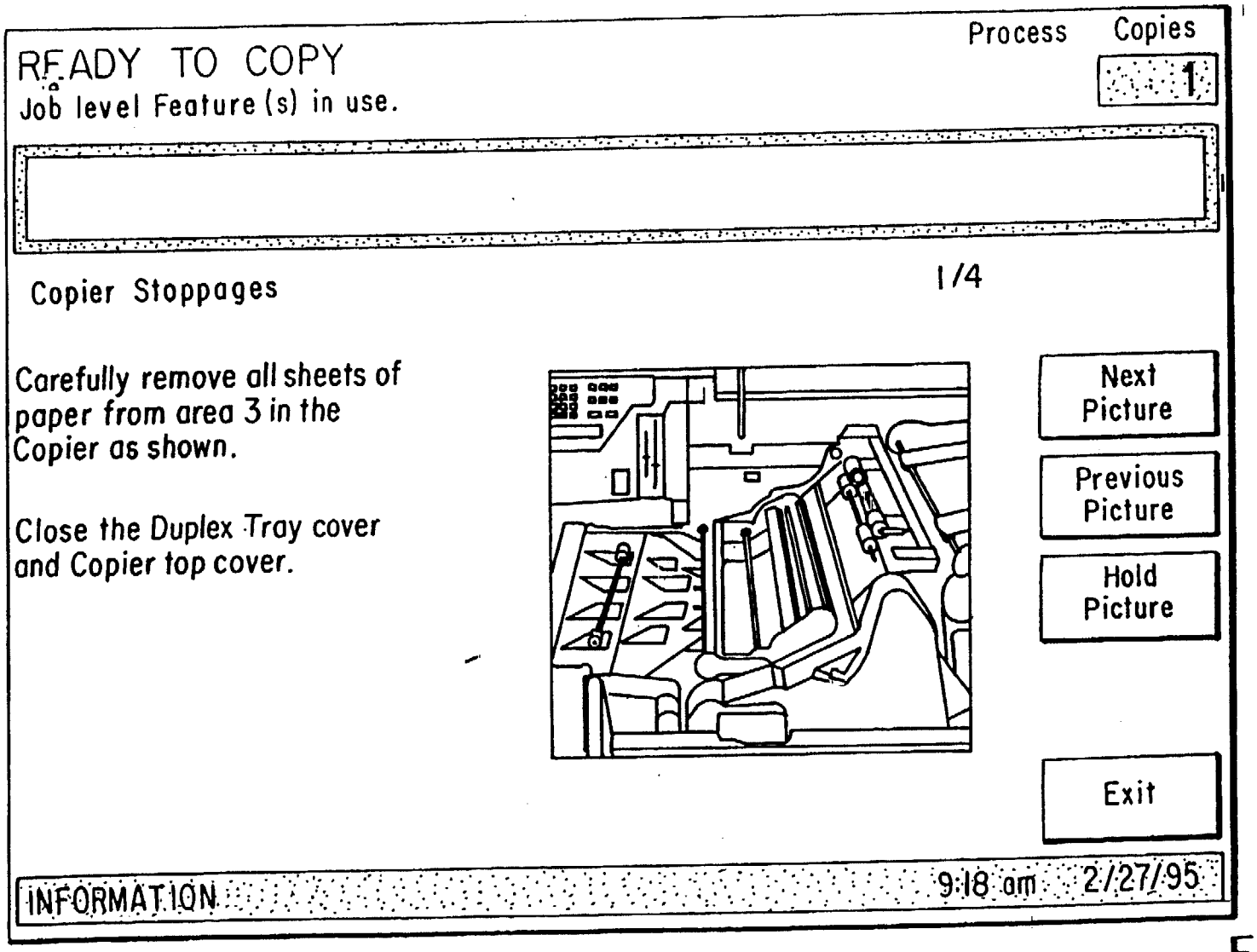
Figure 9:
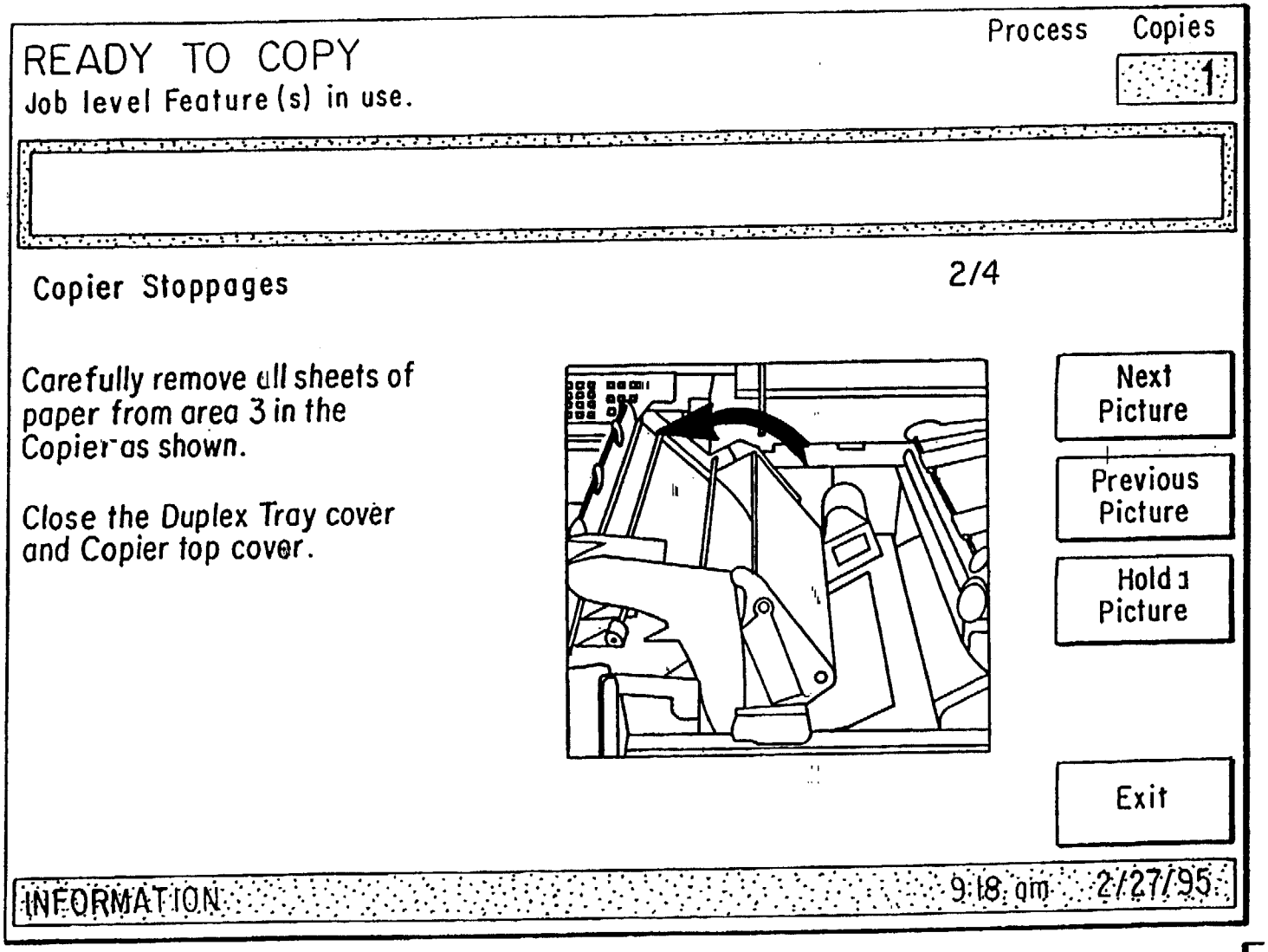
Figure 10:
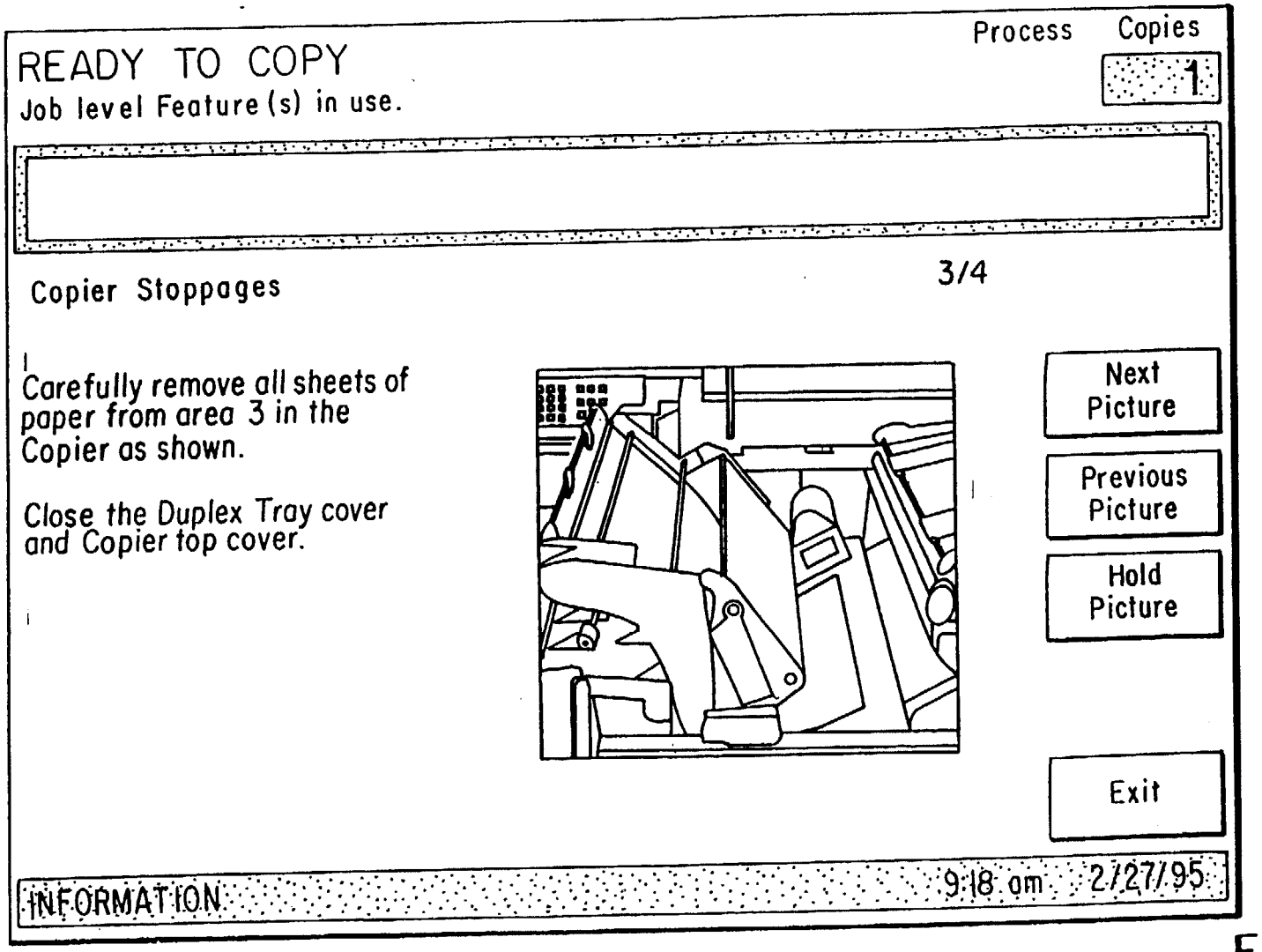

FIGS. 8–13 are useful in explaining the "Next Picture "Previous Picture" feature of the present invention. FIG. shows a more detailed picture of the copy sheet path th shown in FIG. 4. FIG. 9 shows a successive picture with portion of the sheet transport mechanism being raised to t left (arrow). A portion of the copy sheet can be seen. FI 10 shows a picture after the transport mechanism has be raised. In FIGS. 8, 9 and 10, none of the "Picture" butto have been selected, so that the graphics are presented in periodic sequence.

Figure 11:
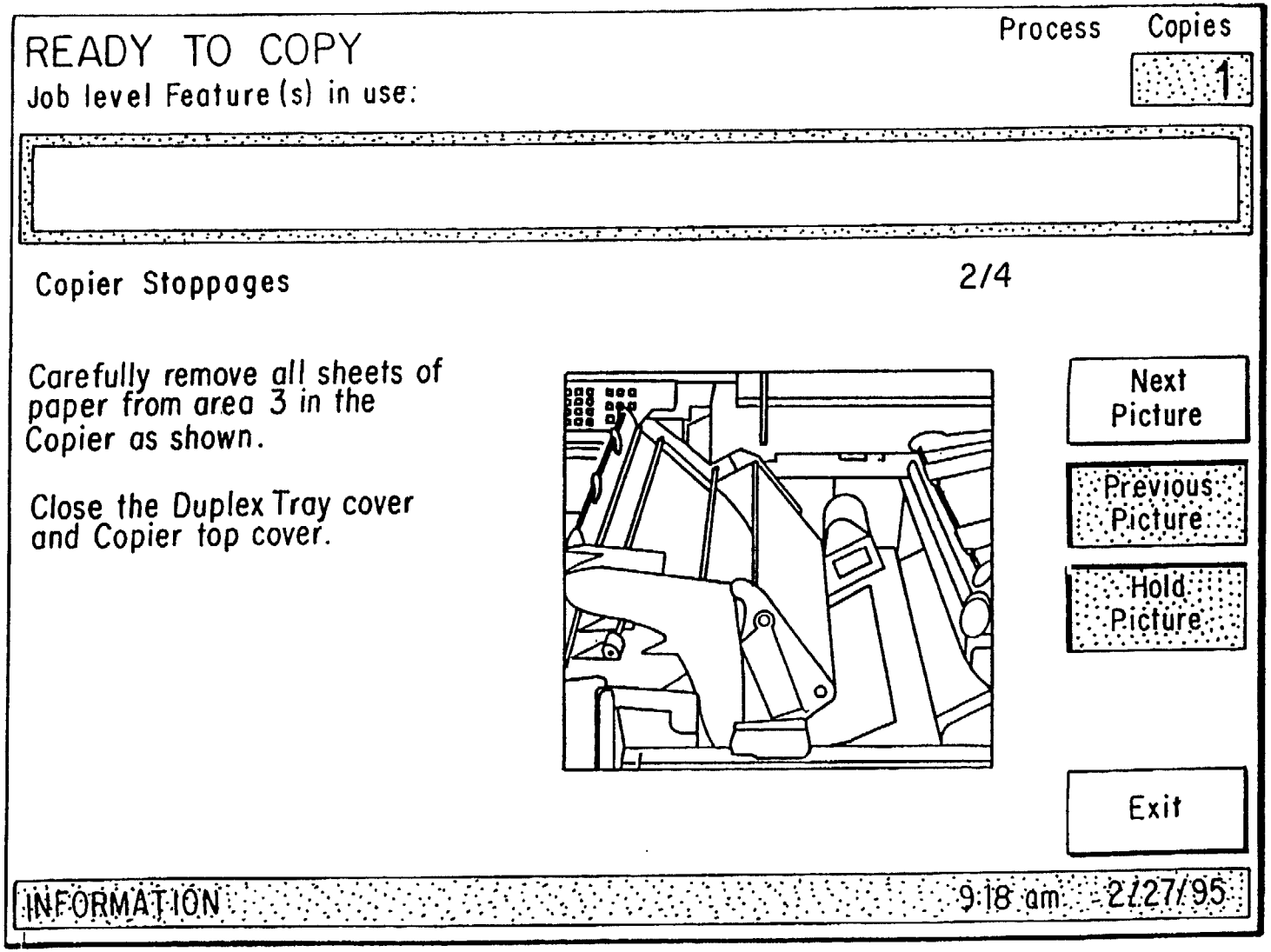
Figure 12:
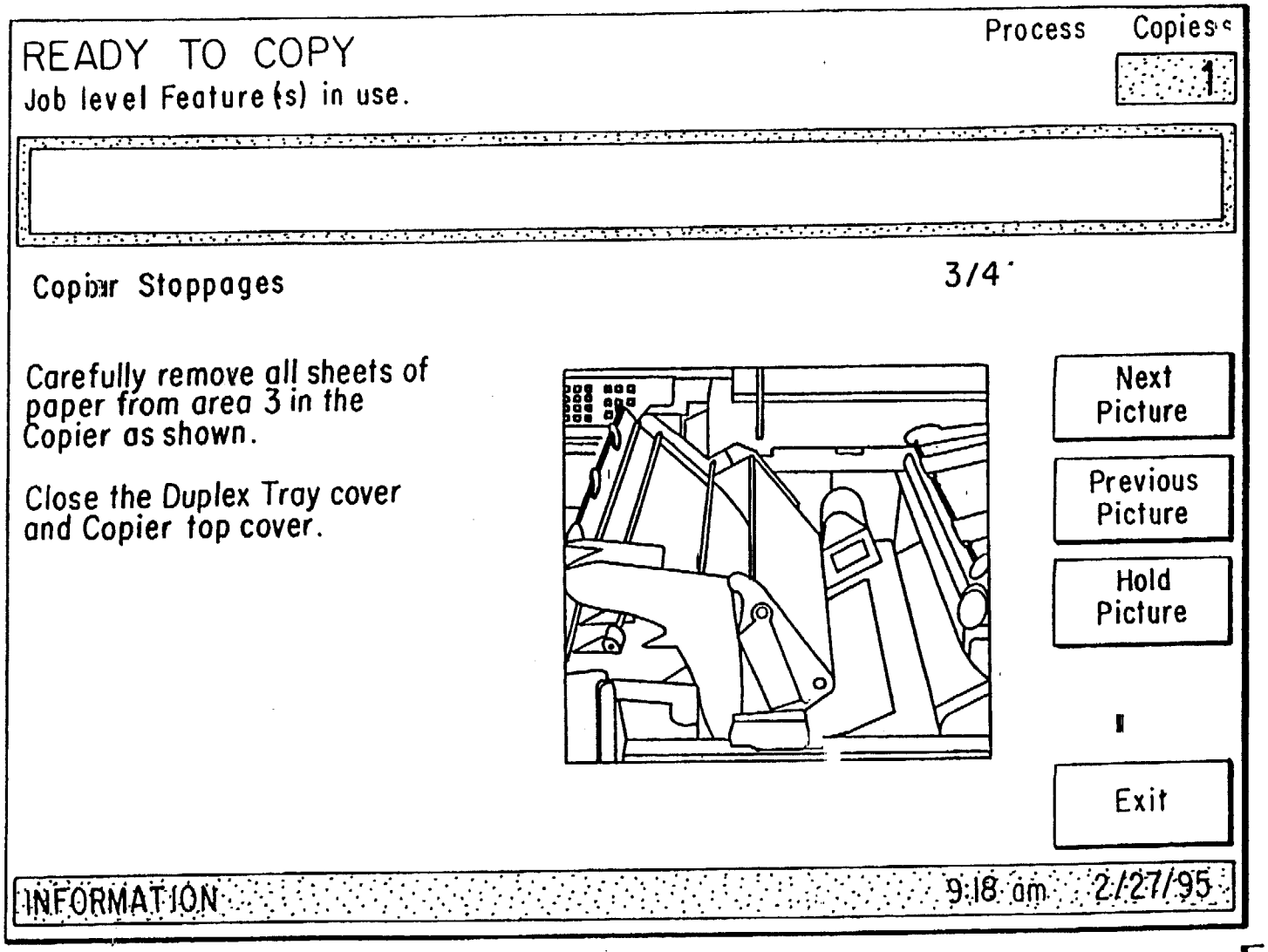
Figure 13:
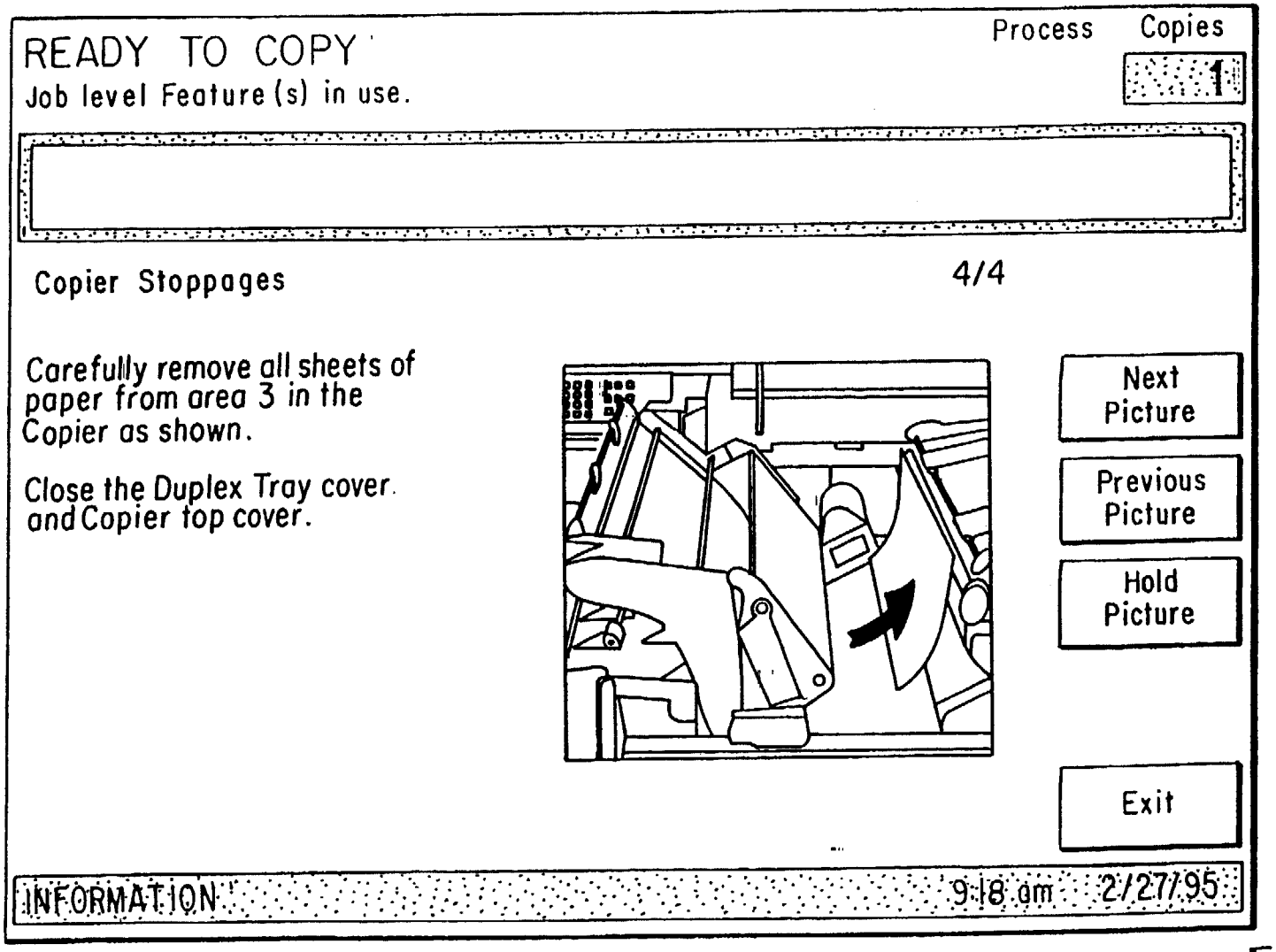

FIG. 11 shows the same picture as FIG. 9 with the "Ho Picture" and "Previous Picture" buttons turned on. FIG. 1 shows the "Hold Picture" and "Previous Picture" butto turned off, resulting in resumption of the periodic sequencing of the graphics so that the same picture as FIG. 10 is displayed (the next graphic after FIG. 8). FIG. 13 shows the next graphic in the sequence illustrating further transport of the copy sheet along its path.

Thus, it is seen, that by selective turning on and off of the "Hold Picture", "Next Picture", and "Previous Picture" buttons, the operator can examine in detail, at his/her own pace, a particular area of the sheet path, thus facilitating clearance of the sheet jam.

Although the invention has been described above in the context of clearing a copy sheet jam in a reproduction apparatus, it will be understood that the invention can be used in other applications where a sequence of graphics are used to assist an operator in eliminating a malfunction, in maintaining the apparatus, in replacement of consumables, and the like.

The invention has been described in detail herein with reference to the figures, however, it will be appreciated that variations and modifications are possible within the spirit and scope of the invention.

What is claimed is:

1. In a reproduction apparatus having a plurality of selectable features for carrying out a reproduction run, an operator control panel for providing operator interface for controlling said reproduction apparatus comprising:

a display for displaying a sequence of graphics at periodic intervals to assist an operator in carrying out a task involving the reproduction apparatus; and a touchscreen overlaying said display having an operator actuable "hold picture" touch button for providing operator input to said reproduction apparatus to cause a current graphic displayed to be held, thereby disabling the periodic sequencing of said graphics when the button is turned on, and to cause resumption of said periodic sequencing of said graphics when said button is turned off.

2. The operator control panel of claim 1 wherein said display displays a sequence of graphics to assist an operator in curing a malfunction in said reproduction apparatus.

3. The operator control panel of claim 1 wherein said display displays a sequence of graphics to assist an operator in clearing a document or copy sheet jam in said reproduction apparatus.

4. The operator control panel of claim 1 wherein said touchscreen includes a "Next Picture" soft button for providing operator input to said reproduction apparatus to cause the next graphic to be displayed.

5. The operator control panel of claim 1 wherein said touchscreen includes a "Previous Picture" soft button for providing operator input to said reproduction apparatus to cause the previous graphic to be displayed.

6. The operator control panel of claim 4 wherein said touchscreen includes a "Previous Picture" soft button for providing operator input to said reproduction apparatus to cause the previous graphic to be displayed.

* * * * *